US012716106B2

(12) United States Patent
Kim

(10) Patent No.: US 12,716,106 B2
(45) Date of Patent: Aug. 25, 2026

(54) EXTREMELY THICK STEEL PLATE FOR STEAM DRUM HAVING EXCELLENT SURFACE QUALITY AND LAMELLAR TEAR RESISTANCE, AND MANUFACTURING METHOD FOR SAME

(71) Applicant: POSCO CO., LTD, Pohang-si (KR)

(72) Inventor: Dae-Woo Kim, Gyeongsangbuk-do (KR)

(73) Assignee: POSCO CO., LTD, Pohang-si (KR)

( * ) Notice: Subject to any disclaimer, the term of this patent is extended or adjusted under 35 U.S.C. 154(b) by 604 days.

(21) Appl. No.: 18/265,574

(22) PCT Filed: Nov. 24, 2021

(86) PCT No.: PCT/KR2021/017415
§ 371 (c)(1),
(2) Date: Jun. 6, 2023

(87) PCT Pub. No.: WO2022/139204
PCT Pub. Date: Jun. 30, 2022

(65) Prior Publication Data

US 2024/0026478 A1 Jan. 25, 2024

(30) Foreign Application Priority Data

Dec. 21, 2020 (KR) ..... 10-2020-0180225

(51) Int. Cl.

| | |
|---|---|
| ***C21D 8/0221*** | (2026.01) |
| ***C21D 6/00*** | (2006.01) |
| ***C21D 8/0247*** | (2026.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |

(52) U.S. Cl.
CPC ..... *C21D 8/0226* (2013.01); *C21D 6/004* (2013.01); *C21D 6/005* (2013.01); *C21D 6/008* (2013.01); *C21D 8/0263* (2013.01); *C22C 38/002* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C21D 2211/005* (2013.01); *C21D 2211/009* (2013.01)

(58) Field of Classification Search
CPC ..... C21D 8/0226; C21D 6/004; C21D 6/005; C21D 6/008; C21D 8/0263; C21D 2211/005; C21D 2211/009; C21D 1/26; C21D 7/13; C21D 8/0273; C21D 9/46; C21D 9/50; C21D 8/0247; C22C 38/002; C22C 38/02; C22C 38/04; C22C 38/06; C22C 38/42; C22C 38/44; C22C 38/46; C22C 38/48; C22C 38/50; C22C 38/58
USPC ..... 148/653
See application file for complete search history.

(56) References Cited

U.S. PATENT DOCUMENTS

| | | | |
|---|---|---|---|
| 2004/0244885 | A1 | 12/2004 | Murakami et al. |
| 2017/0369958 | A1 | 12/2017 | Kitsuya et al. |
| 2019/0024206 | A1 | 1/2019 | Kim |
| 2020/0095649 | A1 | 3/2020 | Cha et al. |
| 2020/0325562 | A1 | 10/2020 | Chae et al. |
| 2021/0062285 | A1 | 3/2021 | Kim |
| 2021/0301365 | A1 | 9/2021 | So et al. |

FOREIGN PATENT DOCUMENTS

| | | | | | |
|---|---|---|---|---|---|
| CN | 1610762 | A | | 4/2005 | |
| CN | 102392195 | A | | 3/2012 | |
| CN | 103911559 | A | | 7/2014 | |
| CN | 108368595 | A | | 8/2018 | |
| CN | 111527227 | A | | 8/2020 | |
| JP | 07-48621 | A | | 2/1995 | |
| JP | 2010106298 | A | * | 5/2010 | |
| JP | 2020-509197 | A | | 3/2020 | |
| JP | 2021-509436 | A | | 3/2021 | |
| KR | 10-2012-0074039 | A | | 7/2012 | |
| KR | 10-2012-0074638 | A | | 7/2012 | |
| KR | 10-2012-0075246 | A | | 7/2012 | |
| KR | 101253890 | B1 | * | 4/2013 | ..... C21D 1/28 |
| KR | 10-2013-0076570 | A | | 7/2013 | |
| KR | 10-2014-0072244 | A | | 6/2014 | |
| KR | 10-2017-0095307 | A | | 8/2017 | |
| KR | 10-2018-0074281 | A | | 7/2018 | |
| KR | 10-2019-0077830 | A | | 7/2019 | |
| KR | 10-2031499 | B1 | | 10/2019 | |
| KR | 10-2021-0079847 | A | | 6/2021 | |

OTHER PUBLICATIONS

JP2010106298A Translation (Year: 2010).*
KR101253890B1 Translation (Year: 2013).*
International Search Report for PCT/KR2021/017415, dated Apr. 6, 2022.
Zhang Yanhua, "Introduction to Thermal Manufacturing 3rd Edition", Beihang University Press, Nov. 30, 2020, p. 237, 5 pages total.
Chinese Office Action dated Sep. 22, 2025 in Application No. 202180085322.9.

* cited by examiner

*Primary Examiner* — Danielle M. Carda
(74) *Attorney, Agent, or Firm* — Sughrue Mion, PLLC

(57) ABSTRACT

According to an aspect of the present invention, an extremely thick steel plate for steam drum having excellent surface quality and lamellar tear resistance and a manufacturing method therefor may be provided.

9 Claims, No Drawings

EXTREMELY THICK STEEL PLATE FOR STEAM DRUM HAVING EXCELLENT SURFACE QUALITY AND LAMELLAR TEAR RESISTANCE, AND MANUFACTURING METHOD FOR SAME

CROSS REFERENCE TO RELATED APPLICATIONS

This application is a National Stage of International Application No. PCT/KR2021/017415 filed Nov. 24, 2021, claiming priority based on Korean Patent Application No. 10-2020-0180225 filed Dec. 21, 2020, the entire disclosures of which are incorporated herein by reference.

TECHNICAL FIELD

The present disclosure relates to steel materials usable for petrochemical power generation facilities, boilers and the like, and a manufacturing method thereof, and more particularly, to an extremely thick steel material for a steam drum having excellent surface quality and lamellar tear resistance and a manufacturing method thereof.

BACKGROUND ART

The boiler steam drum used in power generation facilities is a container that separates steam and water by storing the steam evaporated from the boiler under a certain pressure. Waste heat boilers are widely used to utilize the heat generated from chemical reactions or combustion reactions. When a waste heat boiler is installed, a steam drum is essential. In response to the demand for increased efficiency of steam boilers, the situation is that the thickness of steel materials used for large-scale and large-capacity storage purposes is continuously increasing. As the thickness of the steel material increases, the total rolling reduction decreases, and thus the microstructure increases, and defects in the material, such as inclusions or segregation, show a tendency for the material to deteriorate. Therefore, in order to improve the internal and external soundness of steel materials, there is a tendency to reduce the concentration of impurities such as non-metallic inclusions, segregation or the lie, or to control cracks, voids or the like on the surface and inside the material to the limit.

In particular, in the case of ultra-thick materials with a thickness exceeding 100 mmt, compared to thin materials, since the rolling reduction ratio is not high, the unsolidified shrinkage holes generated during continuous casting or casting are not sufficiently compressed during the rough rolling process and remain in the form of residual voids in the center of the product.

These residual voids act as the initiation point of cracks when the structure is subjected to thickness and axial stress, and eventually, may cause damage to the entire facility in the form of lamellar tearing. Therefore, in the step before rolling, a process of sufficiently compressing the central void is required so that no residual void exists.

Patent Document 1, related thereto, is a technology of applying a strong pressure in a thick plate rough rolling process, and uses a technique for determining the limiting reduction rate for each thickness at which plate bite occurs by thickness from the reduction rate for each pass set to be close to the design tolerance (load and torque) of the rolling mill, a technique of distributing the reduction ratio by adjusting the index of the thickness ratio for each pass to secure the target thickness of the roughing mill, and technology to modify the rolling reduction ratio so that plate bite does not occur based on the limit rolling reduction ratio for each thickness, and thus, provided is a manufacturing method capable of applying an average reduction rate of about 27.5% in the final 3 passes of rough rolling based on 80 mmt. However, in the case of the rolling method, the average reduction rate of the entire product thickness was measured, and in the case of ultra-thick materials with a maximum thickness of 233 mmt or more, it is technically difficult to apply high strain to the center where residual voids are present.

One of the other methods of manufacturing ultra-thick materials is to use a forging machine with a higher effective strain rate per pass than a rolling mill. In Patent Document 2, the casting slab extracted from the heating furnace is placed vertically to give a forging reduction of 400 mm or more across the entire width, and the width forging pass is performed with a reduction within 2 passes, which is a condition within the buckling limit reduction, thereby providing a method of eliminating pores of edge and central portions in the width direction and increasing core strain. Further, since the central residual void, which was a problem in Patent Document 1, may be effectively compressed, and thus, the anti-lamellar tearing quality of the product may be improved.

However, surface defects may occur due to local deformation concentration during the width forging process. In particular, if surface or subsurface defects exist in the cast steel state before forging, the defects propagate during the forging process, and the surface quality may be further deteriorated in the product state after rolling.

On the other hand, Patent Document 3 discloses that a thick high-strength steel sheet of 100 mmt or more having a yield strength of 620 MPa or more may be manufactured by processes of heating a material provided with a predetermined alloy composition at 1200 to 1350° C., performing hot forging with a cumulative reduction of 25% or more, heating to Ac3 point or more and 1200° C. or less, performing hot rolling with a cumulative rolling reduction of 40% or more, reheating to Ac3 point or more and 1050° C. or less, performing rapid cooling from a temperature of the Ac3 point or higher to a lower temperature of 350° C. or lower or the Ar3 point or lower, and tempering at a temperature of 450° C. to 700° C.

However, in the case of the above-mentioned ultra-high strength steel sheet, which is vulnerable to surface cracks during casting due to high carbon equivalent (Ceq) and hardenability index (DI), and in the case of steel for steam drums, which is also manufactured through normalizing heat treatment, the process conditions cannot be readily applied. In addition, when the carbon equivalent (Ceq) and hardenability index (DI) are high, cracks easily occur on the surface of the cast steel due to the formation of hard structure on the surface during the secondary cooling process of steelmaking, and as cracks propagate during the forging process, the surface quality of the final product may be deteriorated.

Therefore, a method of forging to improve the internal soundness of the final product by compressing the central air gap has been proposed, but a practical method has not been proposed to secure both the appropriate material quality and excellent surface quality of steel for steam drums.

PRIOR ART LITERATURE (Patent Document 1) Korean Patent Application Publication No. 10-2012-0075246 (published on Jul. 6, 2012)

(Patent Document 2) Korean Patent Application Publication No. 10-2012-0074039 (published on Jul. 5, 2012)

(Patent Document 3) Korean Patent Application Publication No. 10-2017-0095307 (published on Aug. 22, 2017)

SUMMARY OF INVENTION

Technical Problem

An aspect of the present disclosure is to provide an extremely thick steel material fora steam drum having excellent surface quality and lamellar tear resistance and a manufacturing method thereof.

An aspect of the present disclosure is not limited to the above. A person skilled in the art will have no difficulty understanding the further subject matter of the present disclosure from the general content of this specification.

Solution to Problem

According to an aspect of the present disclosure, an extremely thick steel material includes, in % by weight, C: 0.2 to 0.3%, Si: 0.05 to 0.5%, Mn: 1.0 to 2.0%, Al: 0.005 to 0.1%, P: 0.01% or less, S: 0.015% or less, Nb: 0.001 to 0.02%, V: 0.001 to 0.03%, Ti: 0.001 to 0.03%, Cr: 0.01 to 0.3%, Mo: 0.01 to 0.12%, Cu: 0.01 to 0.4%, Ni: 0.05 to 0.4%, Ca: 0.0005 to 0.004%, a balance of Fe, and other unavoidable impurities, wherein Ceq, according to the following Relationship 1, satisfies a range of 0.5 to 0.6, a ferrite and pearlite composite structure having an average grain size of 20 μm or less is contained as a base structure, and a hard structure fraction in a surface layer portion, which is a region from a surface to 10 mm in a thickness direction, is 5 area % or less, a porosity in a central portion, which is an area of ⅜t to ⅝t (where t is a steel material thickness (mm)), is 0.1 $mm^3/g$ or less, and among precipitates observed in a steel material section after post-weld heat treatment (PWHT), fine VC precipitates with a diameter of 5 to 15 nm are 5 or more per 1 $\mu m^2$.

$$Ceq=[C]+[Mn]/6+([Cr]+[Mo]+[V])/5+([Ni]+[Cu])/15$$
[Relationship 1]

In Relationship 1 above, [C], [Mn], [Cr], [Mo], [V], [Ni] and [Cu] indicate contents (wt %) of C, Mn, Cr, Mo, V, Ni and Cu included in the steel material, respectively, and when these components are not intentionally added, 0 is substituted.

A thickness of the steel material may be 133 to 250 mm.

A tensile strength of the steel material may be 550 to 690 MPa.

Sectional reduction of area (ZRA) of the steel material in the thickness direction may be 35% or more.

A maximum surface crack depth of the steel material may be 0.1 mm or less (including 0).

According to an aspect of the present disclosure, a method of manufacturing an extremely thick steel material includes preparing a slab having a thickness of 650 mm or more, the slab including, in % by weight, C: 0.2 to 0.3%, Si: 0.05 to 0.5%, Mn: 1.0 to 2.0%, Al: 0.005 to 0.1%, P: 0.01% or less, S: 0.015% or less, Nb: 0.001 to 0.02%, V: 0.001 to 0.03%, Ti: 0.001 to 0.03%, Cr: 0.01 to 0.3%, Mo: 0.01 to 0.12%, Cu: 0.01 to 0.4%, Ni: 0.05 to 0.4%, Ca: 0.0005 to 0.004%, a balance of Fe, and other unavoidable impurities, wherein Ceq, according to the following Relationship 1, satisfies a range of 0.5 to 0.6, an average grain size of prior austenite is 500 μm or less, and a thickness is 650 mm or more; primary heating the slab at a temperature ranging from 1100 to 1300° C.; providing a first intermediate material having a thickness of 450 to 550 mm by performing primary forging processing of the primary heated slab at a cumulative reduction of 3 to 15% and a strain rate of 1/s to 4/s; secondary heating the first intermediate material at a temperature ranging from 1000 to 1200° C.; providing a second intermediate material having a thickness of 300 to 340 mm by performing secondary forging processing of the secondary heated first intermediate material at a cumulative reduction of 3 to 30% and a strain rate of 1/s to 4/s; thirdly heating the second intermediate material at a temperature ranging from 1000 to 1200° C.; providing a hot-rolled material having a thickness of 133 to 233 mm by hot rolling the thirdly heated second intermediate material at a temperature ranging from 900 to 1100° C.; and a normalizing heat treatment operation of heating the hot-rolled material after hot rolling is completed at a temperature ranging from 820 to 900° C., maintaining the same for to 40 minutes, and then air-cooling to room temperature.

$$Ceq=[C]+[Mn]/6+([Cr]+[Mo]+[V])/5+([Ni]+[Cu])/15$$
[Relationship 1]

In Relationship 1 above, [C], [Mn], [Cr], [Mo], [V], [Ni] and [Cu] indicate contents (wt %) of C, Mn, Cr, Mo, V, Ni and Cu contained in the steel slab, respectively, and 0 is substituted when these components are not intentionally added.

A porosity of a central portion of the second intermediate material may be 0.1=$mm^3/g$ or less.

A maximum surface crack depth of the hot-rolled steel may be 2 μm or less (including 0).

Operations of welding the normalized heat-treated steel; and performing additional heat treatment (PWHT) to remove residual stress of the welded steel may be further included.

The means for solving the above problems do not enumerate all the features of the present disclosure, and the various features of the present disclosure and the advantages and effects thereof will be understood in more detail with reference to the detailed embodiments below.

Advantageous Effects of Invention

According to an aspect of the present disclosure, an extremely thick steel material fora steam drum having excellent surface quality and lamellar tear resistance and a manufacturing method thereof may be provided.

Effects of the present disclosure are not limited to the above, and may be interpreted as including technical effects that may be inferred from the details described below by those skilled in the art.

BEST MODE FOR INVENTION

The present disclosure relates to an extremely thick steel material fora steam drum having excellent surface quality and lamellar tear resistance and a method of manufacturing the same, and hereinafter, preferred embodiments of the present disclosure will be described. Embodiments of the present disclosure may be modified in various forms, and the scope of the present disclosure should not be construed as being limited to the embodiments described below. These embodiments are provided to those skilled in the art to further elaborate the present disclosure.

Hereinafter, an extremely thick steel material for a steam drum having excellent surface quality and lamellar tear resistance will be described in more detail according to an aspect of the present disclosure.

An extremely thick steel material according to an aspect of the present disclosure includes, in % by weight, C: 0.2 to 0.3%, Si: 0.05 to 0.5%, Mn: 1.0 to 2.0%, Al: 0.005 to 0.1%, P: 0.01% or less, S: 0.015% or less, Nb: 0.001 to 0.02%, V: 0.001 to 0.03%, Ti: 0.001 to 0.03%, Cr: 0.01 to 0.3%, Mo: 0.01 to 0.12%, Cu: 0.01 to 0.4%, Ni: 0.05 to 0.4%, Ca: 0.0005 to 0.004%, a balance of Fe, and other unavoidable impurities, wherein Ceq, according to the following Relationship 1, satisfies a range of 0.5 to 0.6, a ferrite and pearlite composite structure having an average grain size of 20 μm or less is contained as a base structure, and a hard structure fraction in a surface layer portion, which is a region from a surface to 10 mm in a thickness direction, is 5 area % or less, a porosity in a central portion, which is an area of ⅜t to ⅝t (where t is a steel material thickness (mm)), is 0.1 $mm^3/g$ or less, and among precipitates observed in a steel material section after post-weld heat treatment (PWHT), fine VC precipitates with a diameter of 5 to nm are 5 or more per 1 $\mu m^2$.

$$Ceq=[C]+[Mn]/6+([Cr]+[Mo]+[V])/5+([Ni]+[Cu])/15$$

[Relationship 1]

In Relationship 1 above, [C], [Mn], [Cr], [Mo], [V], [Ni] and [Cu] indicate contents (wt %) of C, Mn, Cr, Mo, V, Ni and Cu included in the steel material, respectively, and when these components are not intentionally added, 0 is substituted.

Hereinafter, the alloy composition of the present disclosure will be described in more detail. Hereinafter, unless otherwise indicated, % and ppm described in relation to the alloy composition are based on weight.

Carbon (C): 0.20 to 0.30%

Since carbon (C) is the most important element in securing basic strength, it needs to be contained in steel within an appropriate range, and 0.20% or more of carbon (C) may be added to obtain such an additive effect. Preferably, 0.22% or more of carbon (C) may be added. On the other hand, if the carbon (C) content exceeds a certain level, the fraction of pearlite increases during normalizing heat treatment, and the strength and hardness of the base material may be excessively exceeded, resulting in surface cracks during the forging process and deteriorating lamellar tear resistance in the final product. Therefore, in the present disclosure, the carbon (C) content may be limited to be 0.30%, and a more preferable upper limit of the carbon (C) content may be 0.26%.

Silicon (Si): 0.05 to 0.50%

Silicon (Si) is a substitutional element that improves the strength of steel material through solid solution strengthening and has a strong deoxidizing effect, and thus it is an essential element for manufacturing clean steel. Accordingly, silicon (Si) may be added in an amount of 0.05% or more, more preferably 0.20% or more. On the other hand, in the case in which a large amount of silicon (Si) is added, MA (Martensite-Austenite) phase is formed and the strength of the ferrite matrix is excessively increased, which may deteriorate the surface quality of ultra-thick products. Therefore, the upper limit of the content may be limited to 0.50%. A more preferable upper limit of the content of silicon (Si) may be 0.40%.

Manganese (Mn): 1.0 to 2.0%

Manganese (Mn) is a useful element that improves strength by solid solution strengthening and improves hardenability so that a low-temperature transformation phase is generated. Therefore, in order to secure a tensile strength of 550 MPa or more, it is preferable to add 1.0% or more of manganese (Mn). A more preferable manganese (Mn) content may be 1.1% or more. On the other hand, manganese (Mn) forms MnS, which is a non-metallic inclusion elongated together with sulfur (S), reducing toughness, and acts as a factor that lowers the elongation rate during tension in the thickness direction, and may thus be a factor that rapidly deteriorates the quality of lamellar tear resistance. Therefore, it is preferable to manage the manganese (Mn) content to 2.0% or less, and a more preferable manganese (Mn) content may be 1.5% or less.

Aluminum (Al): 0.005 to 0.1%

Aluminum (Al) is one of the strong deoxidizers in the steelmaking process along with silicon (Si), and is preferably added in an amount of 0.005% or more to obtain this effect. A more preferable lower limit of the aluminum (Al) content may be 0.01%. On the other hand, if the aluminum (Al) content is excessive, the fraction of $Al_2O_3$ in the oxidizing inclusions produced as a result of deoxidation is excessively increased and the size thereof becomes coarse, and there may be a problem that it is difficult to remove the inclusion during refining, which may be a factor lowering the lamellar tear resistance characteristics. Therefore, it is preferable to manage the aluminum (Al) content to 0.1% or less. A more preferable aluminum (Al) content may be 0.07% or less.

Phosphorus (P): 0.010% or less (including 0%), Sulfur (S): 0.0015% or less (including 0%)

Phosphorus (P) and sulfur (S) are elements that cause brittleness at grain boundaries or form coarse inclusions to cause brittleness. Therefore, in order to improve brittle crack propagation resistance, it is preferable to limit phosphorus (P) to 0.010% or less and sulfur (S) to 0.0015% or less.

Niobium (Nb): 0.001 to 0.02%

Niobium (Nb) is an element that precipitates in the form of NbC or NbCN to improve the strength of a base material. In addition, niobium (Nb) dissolved during high-temperature reheating is very finely precipitated in the form of NbC during rolling to suppress recrystallization of austenite, and thus, has the effect of refining the structure. Therefore, niobium (Nb) is preferably added in an amount of 0.001% or more, and a more preferable niobium (Nb) content may be 0.005% or more. On the other hand, if niobium (Nb) is added excessively, undissolved niobium (Nb) is produced in the form of TiNb (C, N) and becomes a factor that inhibits the resistance to lamellar tearing. The upper limit of the niobium (Nb) content is thus preferably limited to 0.02%. A more preferable niobium (Nb) content may be 0.017% or less.

Vanadium (V): 0.001 to 0.03%

Since almost all vanadium (V) is re-dissolved during reheating, the strengthening effect by precipitation or solidification during subsequent rolling is insignificant, but in the subsequent heat treatment process such as PWHT, it is precipitated as very fine carbonitride and has an effect of improving strength. In order to sufficiently obtain these effects, it is necessary to add 0.001% or more of vanadium (V). A more preferable lower limit of the vanadium (V) content may be 0.01%. On the other hand, if the content is excessive, the strength and hardness of the base material and welded zone are excessively increased, which may act as a factor such as surface cracks during steam drum processing and also is not commercially beneficial because manufacturing costs may rise rapidly. Therefore, the vanadium (V) content may be limited to 0.03% or less. Amore preferred vanadium (V) content may be 0.02% or less.

Titanium (Ti): 0.001 to 0.03%

Titanium (Ti) precipitates as TiN during reheating and suppresses the growth of crystal grains in the base material and heat-affected zone of welding, and is a component that greatly improves low-temperature toughness. In order to obtain such an effect, it is preferable that 0.001% or more of titanium (Ti) is added. On the other hand, if titanium (Ti) is excessively added, low-temperature toughness may be reduced due to clogging of the continuous casting nozzle or crystallization of the center. In addition, since titanium (Ti) combines with nitrogen (N) to form coarse TiN precipitates in the center of the thickness, reducing the elongation of the product, the lamellar tear resistance of the final material may deteriorate. Accordingly, the titanium (Ti) content may be 0.03% or less. A preferable titanium (Ti) content may be 0.025% or less, and a more preferable titanium (Ti) content may be 0.018% or less.

Chromium (Cr): 0.01 to 0.30%

Chromium (Cr) is a component that increases yield strength and tensile strength by forming a low-temperature transformation structure by increasing hardenability. In addition, it is also a component effective in preventing a decrease in strength by slowing down the decomposition rate of cementite during tempering after rapid cooling or heat treatment after welding. For this effect, 0.01% or more of chromium (Cr) may be added. On the other hand, if the chromium (Cr) content is excessive, as the size and fraction of Cr-Rich coarse carbides such as $M_{23}C_6$ or the like increase, the impact toughness of the product may decrease, and since the solid solubility of niobium (Nb) and the fraction of fine precipitates such as NbC in the product decrease, a decrease in the strength of the product may be problematic. Therefore, in the present disclosure, the upper limit of the chromium (Cr) content may be limited to 0.30%. The preferable upper limit of the chromium (Cr) content may be 0.25%.

Molybdenum (Mo): 0.01 to 0.12%

Molybdenum (Mo) is an element that increases grain boundary strength and has a high solid-solution strengthening effect in ferrite, and is an element that effectively contributes to increasing strength and ductility of products. In addition, molybdenum (Mo) has an effect of preventing deteriorations in toughness due to grain boundary segregation of impurity elements such as phosphorus (P) and the like. For this effect, 0.10% or more of molybdenum (Mo) may be added. However, since molybdenum (Mo) is an expensive element and excessive addition may significantly increase manufacturing costs, the upper limit of the molybdenum (Mo) content may be limited to 0.12%.

Copper (Cu): 0.01 to 0.40%

Copper (Cu) is an advantageous element in the present disclosure because it may greatly improve the strength of the matrix phase by solid solution strengthening in ferrite and also has an effect of inhibiting corrosion in a wet hydrogen sulfide atmosphere. For this effect, 0.01% or more of copper (Cu) may be included. Amore preferable copper (Cu) content may be 0.03% or more. However, if the content of copper (Cu) is excessive, the possibility of causing star cracks on the surface of the steel sheet increases, and since copper (Cu) is an expensive element, there may be a problem in that manufacturing cost greatly increases. Therefore, in the present disclosure, the upper limit of the copper (Cu) content may be limited to 0.40%. The preferred upper limit of the copper (Cu) content may be 0.35%.

Nickel (Ni): 0.05 to 0.40%

Nickel (Ni) is an element that effectively contributes to improving impact toughness by increasing stacking faults at low temperatures to facilitate cross slip of dislocations, and improving hardenability to improve strength. For this effect, 0.05% or more of nickel (Ni) may be added. A preferred nickel (Ni) content may be 0.10% or more. On the other hand, if nickel (Ni) is added excessively, manufacturing costs may also increase due to high cost, and thus the upper limit of the nickel (Ni) content may be limited to 0.40%. The preferred upper limit of the nickel (Ni) content may be 0.35%.

Calcium (Ca): 0.0005 to 0.0040%,

When calcium (Ca) is added after deoxidation by aluminum (Al), it combines with sulfur (S) forming MnS inclusions to have an effect of suppressing the production of MnS and simultaneously suppressing the occurrence of cracks due to hydrogen-induced cracking by forming spherical CaS. In order to sufficiently form sulfur (S) CaS contained as an impurity, it is preferable to add 0.0005% or more of calcium (Ca). However, if the added amount is excessive, calcium (Ca) remaining after forming CaS combines with oxygen (O) to create coarse oxidative inclusions, which are elongated and destroyed during rolling, which may be a factor in deteriorating lamellar tear resistance. Therefore, the upper limit of the calcium (Ca) content may be limited to 0.0040%.

The extremely thick steel material for a steam drum of the present disclosure may include a balance of Fe and other unavoidable impurities in addition to the above-mentioned components. However, since unintended impurities from raw materials or the surrounding environment may inevitably be mixed in the normal manufacturing process, this cannot be completely ruled out. Since these impurities are known to anyone skilled in the art, all thereof are not specifically mentioned in this specification. In addition, the addition of an effective ingredient other than the above ingredients is not entirely excluded.

In the extremely thick steel material for a steam drum according to an aspect of the present disclosure, Ceq by the following Relationship 1 may satisfy the range of 0.5 to 0.6.

$$Ceq=[C]+[Mn]/6+([Cr]+[Mo]+[V])/5+([Ni]+[Cu])/15$$

[Relationship 1]

In the above Relationship 1, [C], [Mn], [Cr], [Mo], [V], [Ni] and [Cu] means the content (wt %) of C, Mn, Cr, Mo, V, Ni and Cu contained in steel, respectively, and 0 is substituted if these ingredients are not intentionally added.

Since the extremely thick steel material fora steam drum according to an aspect of the present disclosure has a thickness of 133 to 250 mm, it may effectively respond to the trend of increasing the size of steam drums.

The surface layer of the extremely thick steel material fora steam drum according to an aspect of the present disclosure may be formed of a ferrite and pearlite composite structure having an average grain size of 20 μm or less. Since the extremely thick steel material for a steam drum according to an aspect of the present disclosure limits the introduction of hard structure to the surface layer of the steel, the maximum surface crack depth of the final product may be suppressed to 0.1 mm or less. That is, in the extremely thick steel material for a steam drum according to an aspect of the present disclosure, the formation of hard structures such as martensite, bainite and the like on the surface layer of the steel material is actively suppressed, and even when these hard materials are formed inevitably, the fraction thereof may be actively suppressed to 5 area % or less (including 0%). Preferably, the hard structure fraction of the surface layer of the steel material may be 3% or less (including 0%).

In this case, the surface layer of the steel material may mean an area from the surface of the steel material to 10 mm in the thickness direction.

The extremely thick steel material for a steam drum according to an aspect of the present disclosure may include at least 5 or more fine VC precipitates with a diameter of 5 to 15 nm per 1 $\mu m^2$ when observing a cross section of a steel material that has undergone post-weld heat treatment (PWHT). VC is formed in the form of carbide or carbonitride in the temperature range of 600 to 700° C., causing precipitation hardening. Therefore, in the present disclosure, an appropriate strength of 550 MPa or more may be maintained even after heat treatment of the specimen at a high temperature.

In the extremely thick steel material for a steam drum according to an aspect of the present disclosure, the porosity at the center of the steel material may be 0.1 $mm^3/g$ or less. Therefore, the extremely thick steel material for a steam drum according to an aspect of the present disclosure may effectively secure the anti-lamellar tearing quality. In this case, the steel center means ⅜t to ⅝t (t: steel material thickness, mm), and the center porosity may be confirmed by measuring the density and taking the reciprocal.

The extremely thick steel material for a steam drum according to an aspect of the present disclosure may have a tensile strength of 550 to 690 MPa and a sectional reduction of area (ZRA) of 35% or more in the thickness direction. In addition, the extremely thick steel material for a steam drum according to an aspect of the present disclosure may have a maximum surface crack depth of 0.1 mm or less in a final product state. In this case, the depth of the surface crack may be known by determining the existence of surface cracks with the naked eye and then carrying out the grinding until the cracks disappear at the corresponding point when there are cracks and by measuring the depth from the surface layer to the place removed through grinding.

Hereinafter, a method of manufacturing an extremely thick steel material for a steam drum according to an aspect of the present disclosure will be described in more detail.

An extremely thick steel material for a steam drum according to an aspect of the present disclosure may be manufactured by operations of preparing a slab having a thickness of 650 mm or more, the slab including, in % by weight, C: 0.2 to 0.3%, Si: 0.05 to 0.5%, Mn: 1.0 to 2.0%, Al: 0.005 to 0.1%, P: 0.01% or less, S: 0.015% or less, Nb: 0.001 to 0.02%, V: 0.001 to 0.03%, Ti: 0.001 to 0.03%, Cr: 0.01 to 0.3%, Mo: 0.01 to 0.12%, Cu: 0.01 to 0.4%, Ni: 0.05 to 0.4%, Ca: 0.0005 to 0.004%, a balance of Fe, and other unavoidable impurities, wherein Ceq, according to the following Relationship 1, satisfies a range of 0.5 to 0.6, an average grain size of prior austenite is 500 μm or less, and a thickness is 650 mm or more; primary heating the slab at a temperature ranging from 1100 to 1300° C.; providing a first intermediate material having a thickness of 450 to 550 mm by performing primary forging processing of the primary heated slab at a cumulative reduction of 3 to 15% and a strain rate of 1/s to 4/s; secondary heating the first intermediate material at a temperature ranging from 1000 to 1200° C.; providing a second intermediate material having a thickness of 300 to 340 mm by performing secondary forging processing of the secondary heated first intermediate material at a cumulative reduction of 3 to 30% and a strain rate of 1/s to 4/s; thirdly heating the second intermediate material at a temperature ranging from 1000 to 1200° C.; providing a hot-rolled material having a thickness of 133 to 233 mm by hot rolling the thirdly heated second intermediate material at a temperature ranging from 900 to 1100° C.; and a normalizing heat treatment operation of heating the hot-rolled material after hot rolling is completed at a temperature ranging from 820 to 900° C., maintaining the same for 10 to 40 minutes, and then air-cooling to room temperature.

$$Ceq=[C]+[Mn]/6+([Cr]+[Mo]+[V])/5+([Ni]+[Cu])/15$$

[Relationship 1]

In Relationship 1 above, [C], [Mn], [Cr], [Mo], [V], [Ni] and [Cu] indicate contents (wt %) of C, Mn, Cr, Mo, V, Ni and Cu contained in the steel slab, respectively, and 0 is substituted when these components are not intentionally added.

Slab Preparation

The inventor of the present disclosure has conducted in-depth research on a method of manufacturing an extremely thick steel material having excellent surface quality while having physical properties suitable for a steam drum. In particular, in a slab manufactured to a thickness of 650 mm or more, in order to secure strength and surface quality of a final steel material, the carbon equivalent (Ceq) of the slab should be controlled within a certain range, and the prior austenite grain size of the slab should also be recognized as an effective condition, from which the present disclosure has been derived.

Since the slab of the present disclosure is provided with an alloy composition corresponding to the above-described steel material, the description of the alloy composition of the slab is replaced with the description of the alloy composition of the above-described steel material. The alloy composition of the slab used in the present disclosure corresponds to the necessary conditions for securing a tensile strength of 550 to 690 MPa and a sectional reduction of area (ZRA) of 35% or more.

Since the casting speed of the single-sided casting machine for producing slabs with a thickness of 650 mm or more is 0.06 to 0.1 m/min, casting is performed at a significantly slower speed than a general casting machine (casting speed: 0.4 to 1.5 m/min) that manufactures slabs with a thickness of 250 to 400 mm. Therefore, in the case of manufacturing a slab having a thickness of 650 mm or more, since the time maintained in the mold is relatively long, austenite is placed in an environment in which austenite may grow more coarsely.

As the initial austenite grain size increases, the manganese (Mn) segregation index of the austenite grain boundary increases, and because the grain boundary strength is lowered and the hardenability is increased at the same time, in the surface layer portion of the slab, the fraction of hard bainite and martensite, rather than soft ferrite and pearlite, increases. Since the hard structure has a low uniform elongation, when thermal deformation or external deformation or stress is applied, intergranular cracking may easily occur. Therefore, when the grain size of Prior Austenite in the surface layer of the slab is large, intergranular cracking on the surface of the slab may occur more actively, and in a subsequent high deformation process such as forging, rolling and the like, the inflow depth of the crack may further increase. Therefore, in order to suppress surface cracking of the final product, it is very important to control the grain size of prior austenite to an appropriate level or less.

The average grain size of prior austenite of the slab may be derived from the following Relationship 2, and in the present disclosure, intergranular cracking may be effectively suppressed by limiting the average grain size of prior austenite of the slab to 500 μm or less. A preferred average grain size of prior-austenite of the slab may be 400 μm or less, and a more preferred average grain size of prior-austenite of the slab may be 350 μm or less.

$$D(\text{prior austenite grain size of slab after casting})=3600*\exp\{-(89098+3581*[C]+1211*[Ni]+1443*[Cr]+4043*[Mo])/(RT)\}*t^{0.18} \quad \text{[Relationship 2]}$$

In Relationship 2 above, [C], [Ni], [Cr], and [Mo] mean the contents (wt %) of C, Ni, Cr, and Mo contained in the steel slab, respectively, and R is 8.314 J/mol/K, T refers to casting temperature (K), t refers to casting time (s).

As a method to reduce the grain size of prior austenite, there is a method of designing highly components of carbon (C), nickel (Ni), chromium (Cr), and molybdenum (Mo), which have a solute dragging effect or a pinning effect. However, in the case in which the components of these carbon (C), nickel (Ni), chromium (Cr) and molybdenum (Mo) increase, the carbon equivalent (Ceq) is also increased, and a low-temperature transformation structure may be generated during the cooling process of the slab. Therefore, in the present disclosure, the carbon equivalent (Ceq) of the steel slab may be limited to 0.6 or less according to the Relationship 1 below. A preferred carbon equivalent (Ceq) may be 0.5 to 0.6.

$$Ceq=[C]+[Mn]/6+([Cr]+[Mo]+[V])/5+([Ni]+[Cu])/15 \quad \text{[Relationship 1]}$$

In the above Relationship 1, [C], [Mn], [Cr], [Mo], [V], [Ni] and [Cu] means the contents (wt %) of C, Mn, Cr, Mo, V, Ni, and Cu included in the steel slab, respectively, and when these components are not intentionally added, 0 is substituted.

1st Heating of Slab

The prepared slabs may be heated in the temperature range of 1100 to 1300° C. As mentioned above, the thickness of the slab may be 650 mm or more, and a preferred thickness may be 700 mm or more.

It is necessary to heat the slab above a certain temperature range in order to re-dissolve the composite carbonitride of titanium (Ti) or niobium (Nb) or the coarse crystallized product of TiNb(C, N), or the like, formed during casting. In addition, the structure is homogenized by heating and maintaining the slab before the primary forging to a recrystallization temperature or higher, and it is preferable to heat the slab above a certain temperature range in order to secure a sufficiently high forging end temperature to minimize surface layer cracks that may occur during the forging process. Therefore, the slab primary heating of the present disclosure is preferably carried out in a temperature range of 1100° C. or higher.

On the other hand, if the slab heating temperature is excessively high, excessive high-temperature oxide scale may occur, and increase in manufacturing costs due to high temperature heating and maintenance may be excessive. Therefore, the slab primary heating of the present disclosure is preferably carried out in the range of 1300° C. or less.

1st Forging

The first intermediate material may be provided by primary forging processing of the primary heated slab at a cumulative reduction of 3 to 15% and a strain rate of 1/s to 4/s. In this case, 1/s means that the deformation section per second is 100% deformation.

Primary forging is the operation of forging the primary heated heated slab to a thickness of 450 to 550 mm and processing the same to the width of the final second intermediate material. Since low-speed forging with high strain is essential to sufficiently compress the voids, the primary forging may be performed under conditions of a cumulative reduction of 3 to 15% and a strain rate of 1/s to 4/s.

If the cumulative reduction of the primary forging is less than 3%, the remaining voids in the slab cannot be sufficiently compressed, resulting in residual voids, and thus the resistance to lamellar tearing in the final product may be deteriorated. A preferred cumulative reduction of primary forging may be 5% or more, and a more preferred cumulative reduction of primary forging may be 7% or more. However, in the case in which the dislocation density is recovered or the cumulative reduction at the non-recrystallization temperature or lower, which is not offset by recrystallization, exceeds 15%, the uniform elongation of the surface is extremely reduced due to the work hardening of the overlapped dislocations, and surface cracks may occur in the forging process. A preferred cumulative reduction of primary forging may be 13% or less, and a more preferred cumulative reduction of primary forging may be 11% or less.

Secondary Heating and Secondary Forging

Secondary heating of the first intermediate material is performed in the temperature range of 1000 to 1200° C., and secondary forging processing is performed at a cumulative reduction of 3 to 30% and a strain rate of 1/s to 4/s to obtain a second intermediate material having a thickness of 300 to 340 mm. The maximum surface crack depth of the second intermediate material may be 5 μm or less.

Secondary forging is an operation in which the first intermediate material is heated to a temperature range of 1000 to 1200° C. and forged, thereby obtaining the required thickness and length of the final second intermediate material. As in the primary forging, in order to sufficiently lower the porosity in the center of the second intermediate material, high strain low speed forging is essential in the secondary forging. Therefore, the secondary forging may be performed by applying a cumulative reduction of 3 to 30% and a strain rate of 1/s to 4/s. The central porosity of the second intermediate material may be 0.1 $mm^3/g$ or less.

If the cumulative reduction in the secondary forging is not sufficient, the microvoids remaining after the primary forging may not be completely compressed. In addition, in the case in which strain is applied to the end point of the void compressed into an elliptical shape, due to the notch effect, the physical properties may be inferior to those of the circular void form. Therefore, it is necessary to sufficiently compress the voids with a cumulative reduction of 3% or more during the secondary forging. However, if the accumulated reduction is excessive, since surface cracks may occur due to surface work hardening, the upper limit of the cumulative reduction may be limited to 30%.

The strain rate of the secondary forging may be 1/s to 4/s as in the primary forging. At a strain rate of less than 1/s, the temperature of the finish forging decreases, and surface cracks may occur. On the other hand, when a high strain rate exceeding 4/s is applied in the non-recrystallization region, elongation reduction and surface cracking may be caused.

Tertiary Heating and Hot Rolling

The second intermediate material after forging work may be heated tertiary in the temperature range of 1000 to 1200° C.

The composite carbonitride of titanium (Ti) or niobium (Nb) formed during casting or the coarse crystallized product of TiNb(C, N) or the like is re-dissolved, and the structure is homogenized by heating and maintaining the second intermediate material before hot rolling to a recrystallization temperature or higher, and the tertiary heating may be performed in the temperature range of 1000° C. or higher to minimize the crushing of inclusions in the rolling process by ensuring a sufficiently high rolling end temperature.

On the other hand, if the second intermediate material is heated to an excessively high temperature, oxide scale at high temperature may be problematic, and increase in manufacturing costs due to high temperature heating and maintenance may be a problem, and thus in the present disclosure, the upper limit of the tertiary heating temperature may be limited to 1200° C.

A hot-rolled material having a thickness of 133 to 233 mm by hot rolling the tertiary heated second intermediate material in a temperature range of 900 to 1100° C. may be provided. The maximum surface crack depth of hot-rolled steel may be 2 μm or less.

If the finish hot rolling temperature is less than 900° C., the deformation resistance value excessively increases with the temperature drop, and it is thus difficult to sufficiently refine the austenite crystal grains in the center in the thickness direction of the product, which may deteriorate the lamellar tear resistance of the final product. On the other hand, if the hot rolling temperature exceeds 1100° C., since the austenite crystal grains become excessively coarse, there is a concern that strength and impact toughness may be deteriorated. Therefore, the hot rolling temperature is preferably 900 to 1100° C.

Normalizing Heat Treatment

Normalizing heat treatment may be performed by heating the hot-rolled steel after hot rolling to a temperature range of 820 to 900° C., holding the same for 10 to 40 minutes, and then air-cooling to room temperature.

During the normalizing heat treatment, if the heating temperature is less than 820° C. or the holding time is less than minutes, since carbides generated during cooling after rolling or impurity elements segregated at grain boundaries do not smoothly re-dissolve, the thickness direction elongation (ZRA) and low-temperature toughness of the steel material may be greatly reduced. On the other hand, in the case of normalizing heat treatment, if the heating temperature exceeds 900° C. or the holding time exceeds 40 minutes, due to coarsening of austenite and coarsening of precipitated phases such as Nb(C, N), V(C, N) and the like, resistance to lamellae tearing may deteriorate.

Post-Weld Heat Treatment (PWHT)

In the post-weld heat treatment, additional heat treatment (ASME section VIII-Division 1, Table UCS-56) may be performed to weld normalized products and remove residual stress. As an example, for a steel material having a thickness of 180 mm, heat treatment after welding under conditions of 635° C. and 370 minutes may be performed.

MODE FOR INVENTION

Hereinafter, the present disclosure will be described in more detail through examples. However, it should be noted that the examples to be described later are only for exemplifying the present disclosure to make it more specific, and are not intended to limit the scope of the present disclosure.

Example

A cast steel having a thickness of 700 mm having the alloy components illustrated in Table 1 was manufactured. Primary forging, secondary forging, hot rolling and normalizing heat treatment were performed according to the process conditions in Table 2. At this time, the primary heating temperature of 1200° C., the secondary heating temperature of 1100° C., and the tertiary heating temperature of 1050° C. were commonly applied, and the normalization time of 30 minutes was commonly applied. For the thickness of the first intermediate material, the condition of 550 mm was applied, and for the thickness of the second intermediate material, the condition of 400 mm was applied. Except for the process conditions described in Table 2, process conditions satisfying the scope of the present disclosure were applied.

TABLE 1

| Steel | Alloy Composition (wt %) | | | | | | | | | | | | | | |
|---|---|---|---|---|---|---|---|---|---|---|---|---|---|---|---|
| grade No. | C | Si | Mn | Al | P* | S* | Nb | V | Ti | Cr | Mo | Cu | Ni | Ca* | Ceq |
| Inventive Steel 1 | 0.23 | 0.35 | 1.45 | 0.03 | 80 | 10 | 0.016 | 0.015 | 0.011 | 0.02 | 0.10 | 0.23 | 0.27 | 25 | 0.532 |
| Inventive Steel 2 | 0.23 | 0.37 | 1.35 | 0.03 | 80 | 10 | 0.016 | 0.015 | 0.013 | 0.11 | 0.10 | 0.23 | 0.27 | 25 | 0.533 |
| Inventive Steel 3 | 0.24 | 0.35 | 1.36 | 0.03 | 85 | 12 | 0.013 | 0.017 | 0.012 | 0.17 | 0.08 | 0.18 | 0.25 | 22 | 0.549 |
| Inventive Steel 4 | 0.23 | 0.35 | 1.43 | 0.02 | 81 | 10 | 0.015 | 0.02 | 0.012 | 0.25 | 0.06 | 0.22 | 0.19 | 21 | 0.562 |
| Inventive Steel 5 | 0.22 | 0.33 | 1.44 | 0.03 | 83 | 11 | 0.016 | 0.018 | 0.015 | 0.23 | 0.11 | 10.19 | 0.23 | 20 | 0.56 |
| Comparative Steel 1 | 0.34 | 0.28 | 1.39 | 0.02 | 82 | 13 | 0.018 | 0.015 | 0.001 | 0.18 | 0.08 | 0.13 | 0.22 | 22 | 0.65 |
| Comparative Steel 2 | 0.21 | 0.31 | 0.89 | 0.02 | 85 | 12 | 0.018 | 0.013 | 0.010 | 0.19 | 0.11 | 0.22 | 0.18 | 23 | 0.448 |
| Comparative Steel 3 | 0.24 | 0.33 | 1.4 | 0.03 | 84 | 10 | 0.019 | 0.17 | 0.015 | 0.22 | 0.09 | 0.21 | 0.15 | 22 | 0.593 |
| Comparative Steel 4 | 0.23 | 0.30 | 1.41 | 0.3 | 83 | 10 | 0.015 | 0.0005 | 0.01 | 0.09 | 0.11 | 0.20 | 0.19 | 22 | 0.531 |

P*, s* and Ca* mean those listed in ppm

TABLE 2

| Division | Steel grade No. | Slab prior-austenite average grain size (μm) | Primary forging cumulative reduction (%) | Secondary forging strain rate (/s) | Finish rolling temperature (° C.) | Normalizing temperature (° C.) |
|---|---|---|---|---|---|---|
| Inventive Example 1 | Inventive Steel 1 | 302 | 10 | 3 | 935 | 890 |
| Inventive Example 2 | Inventive Steel 2 | 297 | 8 | 2.7 | 950 | 880 |
| Inventive Example 3 | Inventive Steel 3 | 317 | 9 | 3.9 | 971 | 860 |
| Inventive Example 4 | Inventive Steel 4 | 286 | 8 | 4 | 952 | 880 |
| Inventive Example 5 | Inventive Steel 5 | 279 | 1 7 | 3.4 | 938 | 843 |
| Comparative Example 1 | Inventive Steel 1 | 299 | 2.7 | 2.8 | 925 | 852 |
| Comparative Example 2 | Inventive Steel 2 | 351 | 10 | 8.7 | 929 | 869 |
| Comparative Example 3 | Inventive Steel 3 | 342 | 14 | 3.1 | 793 | 840 |
| Comparative Example 4 | Inventive Steel 4 | 352 | 13 | 3.5 | 908 | 800 |
| Comparative Example 5 | Comparative Steel 1 | 337 | 12 | 4 | 918 | 832 |
| Comparative Example 6 | Comparative Steel 2 | 361 | 11 | 1 | 929 | 866 |
| Comparative Example 7 | Comparative Steel 3 | 298 | 9 | 3 | 973 | 873 |
| Comparative Example 8 | Comparative Steel 4 | 335 | 9 | 2.7 | 950 | 841 |

Afterwards, the mechanical property values of respective specimens were measured and listed in Table 3. The microstructure of each specimen was observed using SEM, and it was confirmed that all specimens had a ferrite and pearlite composite structure with an average grain size of 20 μm or less as a base structure. For the hard structure fraction of the surface layer, MA was revealed from the surface layer structure specimen through LePera etching, and then the size was measured using an automatic image analyzer, and the center porosity was determined by measuring the density in the center of the specimen. In addition, tensile strength and reduction of area (ZRA) of the cross-section in the thickness direction of each specimen were measured using a tensile tester. In addition, after visually observing the surface of each specimen, grinding was performed at the point where the surface crack was formed, and the grinding depth until the crack disappeared was measured as the surface crack depth. The VC precipitate was analyzed using TEM-Replica, and the crystal structure of VC was confirmed by first measuring the diffraction pattern. Since in the VC precipitate, the (001) plane is parallel to the (001) plane of ferrite, and the [110] direction of the VC precipitate thus forms a Baker-Nutting orientation relation parallel to the [100] direction of ferrite, it may be easily found on the TEM image. For statistical processing, several 200 $nm^2$×200 $nm^2$ images were used to count the number of VC precipitates per 1 $\mu m^2$.

TABLE 3

| Division | Steel grade No. | Surface layer portion hard structure fraction (%) | Central portion porosity ($mm^3/g$) | Number of fine VC precipitates (pcs/$\mu m^2$) | Tensile strength (MPa) | ZRA (%) | Plate surface crack depth (μm) | Final material thickness (mm) |
|---|---|---|---|---|---|---|---|---|
| Inventive Example 1 | Inventive Steel 1 | 0.1 | 0.013 | 84 | 584 | 51 | 0 | 147 |
| Inventive Example 2 | Inventive Steel 2 | 1.2 | 0.022 | 59 | 589 | 55 | 0 | 156 |
| Inventive Example 3 | Inventive Steel 3 | 0.8 | 0.015 | 65 | 570 | 63 | 0 | 183 |
| Inventive Example 4 | Inventive Steel 4 | 0.9 | 0.017 | 102 | 564 | 57 | 0 | 200 |
| Inventive Example 5 | Inventive Steel 5 | 1.3 | 0.018 | 76 | 591 | 53 | 0 | 193 |
| Comparative Example 1 | Inventive Steel 1 | 0.8 | 0.209 | 54 | 584 | 12 | 0 | 184 |
| Comparative Example 2 | Inventive Steel 2 | 1.2 | 0.019 | 46 | 568 | 58 | 8.3 | 188 |
| Comparative Example 3 | Inventive Steel 3 | 1.1 | 0.013 | 44 | 602 | 63 | 5.9 | 169 |

TABLE 3-continued

| Division | Steel grade No. | Surface layer portion hard structure fraction (%) | Central portion porosity ($mm^3/g$) | Number of fine VC precipitates (pcs/$\mu m^2$) | Tensile strength (MPa) | ZRA (%) | Plate surface crack depth (μm) | Final material thickness (mm) |
|---|---|---|---|---|---|---|---|---|
| Comparative Example 4 | Inventive Steel 4 | 0.8 | 0.011 | 39 | 588 | 17 | 0 | 173 |
| Comparative Example 5 | Comparative Steel 1 | 27 | 0.017 | 49 | 719 | 20 | 10.5 | 159 |
| Comparative Example 6 | Comparative Steel 2 | 1.2 | 0.015 | 57 | 501 | 58 | 0 | 190 |
| Comparative Example 7 | Comparative Steel 3 | 19 | 0.035 | 94 | 569 | 57 | 7.9 | 192 |
| Comparative Example 8 | Comparative Steel 4 | 1.1 | 0.020 | 1 | 521 | 59 | 0 | 185 |

As can be seen from Tables 1 to 3, in the case of Inventive Examples 1 to 5 satisfying the alloy composition and manufacturing conditions proposed by the present disclosure, and it can be seen that excellent tensile strength, lamellar tear resistance (ZRA quality) and surface quality may be secured.

However, in the case of Comparative Examples 1 to 4, the alloy composition proposed by the present disclosure is satisfied, but the manufacturing conditions are not satisfied. It can be seen that the strength, ZRA, and surface quality characteristics are low as the surface layer microstructure type and fraction, or the central porosity characteristics, proposed by the present disclosure, are not satisfied.

In the case of Comparative Examples 5 to 7, since the manufacturing conditions proposed by the present disclosure are satisfied, but the alloy composition is not satisfied, it can be seen that the strength, ZRA, and surface quality are low as the conditions such as the type and fraction of the microstructure, the porosity in the center, and the like proposed by the present disclosure, are not satisfied. In the case of Comparative Example 8, since the number of VC precipitates proposed by the present disclosure is not satisfied, it can be seen that the tensile strength is relatively low.

Although the present disclosure has been described in detail through examples above, other types of embodiments are also possible. Therefore, the spirit and scope of the claims set forth below are not limited to the embodiments.

The invention claimed is:

1. A steel material comprising:

in % by weight, C: 0.2 to 0.3%, Si: 0.05 to 0.5%, Mn: 1.0 to 2.0%, Al: 0.005 to 0.1%, P: 0.01% or less, S: 0.015% or less, Nb: 0.001 to 0.02%, V: 0.001 to 0.03%, Ti: 0.001 to 0.03%, Cr: 0.01 to 0.3%, Mo: 0.01 to 0.12%, Cu: 0.01 to 0.4%, Ni: 0.05 to 0.4%, Ca: 0.0005 to 0.004%, a balance of Fe, and other unavoidable impurities, wherein Ceq, according to the following Relationship 1, satisfies a range of 0.5 to 0.6, a ferrite and pearlite composite structure having an average grain size of 20 μm or less is contained as a base structure, and a hard structure fraction in a surface layer portion, which is a region from a surface to 10 mm in a thickness direction, is 5 area % or less, a porosity in a central portion, which is an area of 3/8t to 5/8t, where t is a steel material thickness in mm, is 0.1 $mm^3/g$ or less, and among precipitates observed in a steel material section after post-weld heat treatment (PWHT), fine VC precipitates with a diameter of 5 to 15 nm are 5 or more per 1 $\mu m^2$, $$Ceq=[C]+[Mn]/6+([Cr]+[Mo]+[V])/5+([Ni]+[Cu])/15 \quad \text{[Relationship 1]}$$

wherein, in Relationship 1 above, [C], [Mn], [Cr], [Mo], [V], [Ni] and [Cu] indicate contents in wt % of C, Mn, Cr, Mo, V, Ni and Cu included in the steel material, respectively, and when these components are not intentionally added, 0 is substituted.

2. The steel material of claim 1, wherein a thickness of the steel material is 133 to 250 mm.

3. The steel material of claim 1, wherein a tensile strength of the steel material is 550 to 690 MPa.

4. The steel material of claim 1, wherein a sectional reduction of area (ZRA) of the steel material in the thickness direction is 35% or more.

5. The steel material of claim 1, wherein a maximum surface crack depth of the steel material is 0.1 mm or less, including 0.

6. A method of manufacturing the steel material of claim 1, comprising:

preparing a slab having a thickness of 650 mm or more, the slab including, in % by weight, C: 0.2 to 0.3%, Si: 0.05 to 0.5%, Mn: 1.0 to 2.0%, Al: 0.005 to 0.1%, P: 0.01% or less, S: 0.015% or less, Nb: 0.001 to 0.02%, V: 0.001 to 0.03%, Ti: 0.001 to 0.03%, Cr: 0.01 to 0.3%, Mo: 0.01 to 0.12%, Cu: 0.01 to 0.4%, Ni: 0.05 to 0.4%, Ca: 0.0005 to 0.004%, a balance of Fe, and other unavoidable impurities, wherein Ceq, according to the following Relationship 1, satisfies a range of 0.5 to 0.6, an average grain size of prior austenite is 500 μm or less, and a thickness is 650 mm or more;

primarily heating the slab at a temperature ranging from 1100 to 1300° C.;

providing a first intermediate material having a thickness of 450 to 550 mm by performing primary forging processing of the primary heated slab at a cumulative reduction of 3 to 15% and a strain rate of 1/s to 4/s;

secondarily heating the first intermediate material at a temperature ranging from 1000 to 1200° C.;

providing a second intermediate material having a thickness of 300 to 340 mm by performing secondary forging processing of the secondary heated first intermediate material at a cumulative reduction of 3 to 30% and a strain rate of 1/s to 4/s;

thirdly heating the second intermediate material at a temperature ranging from 1000 to 1200° C.;

providing a hot-rolled material having a thickness of 133 to 233 mm by hot rolling the thirdly heated second intermediate material at a temperature ranging from 900 to 1100° C.; and a normalizing heat treatment operation of heating the hot-rolled material after hot rolling is completed at a temperature ranging from 820 to 900° C., maintaining the same for 10 to 40 minutes, and then air-cooling to room temperature, $$Ceq=[C]+[Mn]/6+([Cr]+[Mo]+[V])/5+([Ni]+[Cu])/15$$

[Relationship 1]

wherein, in Relationship 1 above, [C], [Mn], [Cr], [Mo], [V], [Ni] and [Cu] indicate contents in wt % of C, Mn, Cr, Mo, V, Ni and Cu contained in the steel slab, respectively, and 0 is substituted when these components are not intentionally added.

7. The method of manufacturing a steel material of claim 6, wherein a porosity of a central portion of the second intermediate material is 0.1 $mm^3/g$ or less.

8. The method of manufacturing a steel material of claim 6, wherein a maximum surface crack depth of the hot-rolled steel is 2 μm or less, including 0.

9. The method of manufacturing a steel material of claim 6, further comprising;

welding the normalized heat-treated steel; and performing additional post-weld heat treatment (PWHT) to remove residual stress of the welded steel.

* * * * *